US006131374A

United States Patent [19]

Bois

[11] Patent Number: 6,131,374

[45] Date of Patent: Oct. 17, 2000

[54] METHOD OF AUTOMATICALLY MANUFACTURING BAGS, A MACHINE FOR IMPLEMENTING THE METHOD, AND RESULTING BAGS

[75] Inventor: Henri Georges Bois, Neuilly sur Seine, France

[73] Assignee: Flexico-France, Henonville, France

[21] Appl. No.: 09/165,773

[22] Filed: Oct. 2, 1998

[30] Foreign Application Priority Data

Oct. 3, 1997 [FR] France ..... 97 12330

[51] Int. Cl.[7] ..... B65B 9/08; B65B 61/18; B31B 1/90

[52] U.S. Cl. ..... 53/451; 53/139.2; 53/416; 493/214; 493/927

[58] Field of Search ..... 53/410, 416, 451, 53/139.2, 133.4, 450, 550, 551, 552; 493/213, 214, 927

[56] References Cited

U.S. PATENT DOCUMENTS

| | | | |
|---|---|---|---|
| 3,986,914 | 10/1976 | Howard | 493/214 X |
| 4,651,504 | 3/1987 | Bentsen | 493/214 X |
| 4,812,074 | 3/1989 | Ausnit et al. | 493/214 X |
| 4,909,017 | 3/1990 | McMahon et al. | 53/139.2 X |
| 4,929,225 | 5/1990 | Ausnit et al. | 493/214 X |
| 5,188,461 | 2/1993 | Sorensen | 493/214 X |
| 5,558,613 | 9/1996 | Tilman et al. | 493/214 |

FOREIGN PATENT DOCUMENTS

| | | |
|---|---|---|
| 0 282 723 | 9/1988 | European Pat. Off. . |
| 0 410 126 A1 | 1/1991 | European Pat. Off. . |
| 0 792 801 A1 | 9/1997 | European Pat. Off. . |
| 0 792 802 A1 | 9/1997 | European Pat. Off. . |
| WO 97/06062 | 2/1997 | WIPO . |

OTHER PUBLICATIONS

French Search Report (Jun. 15, 1998).

*Primary Examiner*—James F. Coan

*Attorney, Agent, or Firm*—Pitney, Hardin, Kipp and Szuch LLP

[57] ABSTRACT

The present invention relates to a method of forming and closing bags, said method comprising steps consisting in delivering closure means comprising at least two complementary strips disposed on respective backing sheets, in delivering a film that is to constitute the walls of the bag, in heat-sealing a first backing sheet of the closure means to the film along at least one of the longitudinal edges of said sheet, with the closure means being angularly positioned transversely to the longitudinal direction of the film, in shaping the resulting film as equipped with the closure means into a tube, and in heat-sealing the second backing sheet of the closure means to an opposite face of the film along only one edge of said second sheet.

13 Claims, 2 Drawing Sheets

METHOD OF AUTOMATICALLY MANUFACTURING BAGS, A MACHINE FOR IMPLEMENTING THE METHOD, AND RESULTING BAGS

The present invention relates to automatically manufacturing bags or sachets provided with complementary closure strips suitable for enabling them to be opened and closed successively and at will by the user.

BACKGROUND OF THE INVENTION

Numerous means have already been proposed for this purpose, as regards both strips and also machines and methods for manufacturing such bags or sachets.

Examples of such means can be found in Documents U.S. Pat. No. 5,242,516, U.S. Pat. No. 5,216,787, FR-A-2 613 326, U.S. Pat. No. 4,909,017, U.S. Pat. No. 4,617,683, U.S. Pat. No. 4,709,533, EP-A-0 398 732, EP-A-0 635 433, U.S. Pat. No. 4,817,188, and U.S. Pat. No. 5,412,924.

OBJECTS AND SUMMARY OF THE INVENTION

An object of the present invention is to provide novel means making it possible to make such bags or sachets provided with complementary closure strips.

The present invention achieves this object by means of a method of forming and closing bags, said method comprising the following steps:

delivering closure means comprising at least two complementary strips disposed on respective backing sheets;

delivering a film that is to constitute the walls of the bag;

heat-sealing a first backing sheet of the closure means to the film along at least one of the longitudinal edges of said sheet, with the closure means being angularly positioned transversely to the longitudinal direction of the film;

shaping the resulting film as equipped with the closure means into a tube; and heat-sealing the second backing sheet of the closure means to an opposite face of the film along only one edge of said second sheet.

The present invention further provides a machine for implementing the method, as well as bags and intermediate products obtained by means of the method.

BRIEF DESCRIPTION OF THE DRAWINGS

Other characteristics, objects, and advantages of the present invention appear on reading the following detailed description with reference to the accompanying drawings which are given by way of non-limiting example, and in which.

MORE DETAILED DESCRIPTION

Figure 1:
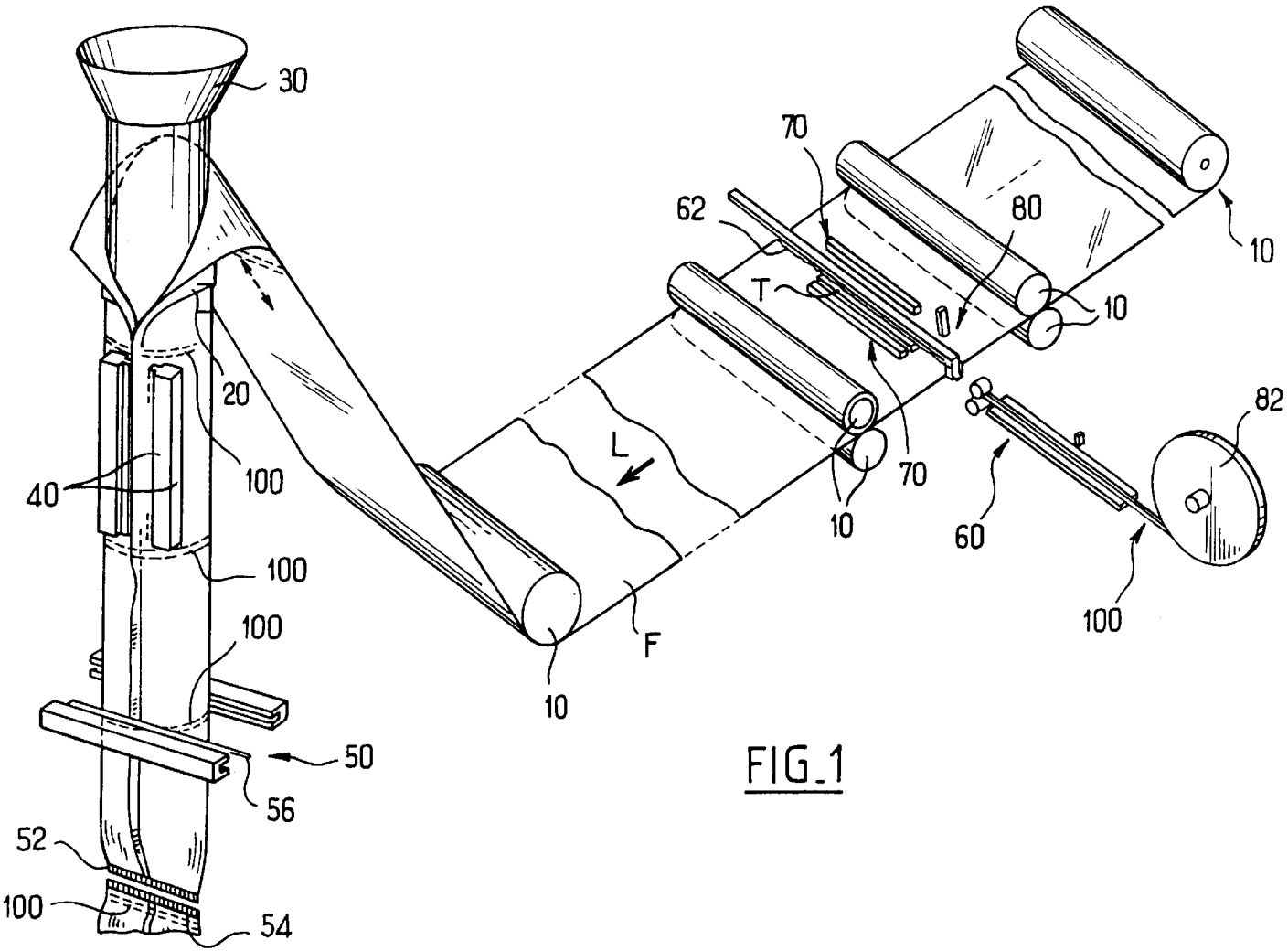
FIG. 1 is a diagrammatic perspective view of a machine of the present invention for automatically forming, filling, and closing bags.

Accompanying FIG. 1 shows a machine for automatically forming, filling, and closing bags provided with complementary closure strips 100, which machine comprises:

means 10 for conveying a film F in a longitudinal direction L;

a forming neck 20;

a filling chute 30;

longitudinal heat-sealing means 40; and transverse heat-sealing and bag-separation means 50.

The forming neck 20 receives at its inlet the film F in the plane state (and provided with the closure means 100 as specified below). It delivers at its output the film F as shaped into a tube. In the context of the present invention, the expression "tube" or "tubular" should not be considered as being limited to a circularly-symmetrical tubular section. It also covers, in particular, any polygonal tubular section.

The filling chute 30 opens out into the forming neck 20 and into the tube formed from the film F at the outlet of the forming neck 20.

The longitudinal heat-sealing means 40 are suitable for closing the resulting formed tube by uniting the two longitudinal edges of the film F.

The transverse heat-sealing means 50 are preferably suitable for sequentially generating a first transverse heat seal 52 before a product is inserted into the tube via the filling chute 30, and then a second transverse heat seal 54 once the product has been inserted into the tube, so as to close a bag therearound. In practice, as can be imagined from FIG. 1, the two transverse heat seals 52 and 54 may be generated simultaneously, on either said of cutting means 56 for separating the bags, by means of double heat-sealing jaws 50.

The heat-sealing means 40 and 50 are preferably formed of heater jaws moved cyclically towards the film and away therefrom in a direction orthogonal to the axis of displacement of the film.

Since the general structure of the machine is known, it is not described in detail below In the context of the present invention, the machine further comprises:

delivery means 60 suitable for delivering segments T of closure means 100 comprising two elements 110, 120 constituting two complementary strips 112, 122 disposed on respective backing sheets 114, 124;

heat-sealing means 70 suitable for heat-sealing a first backing sheet 114 of the closure means 100 to the film F along at least one of the longitudinal edges of said sheet 114, upstream from the forming neck 20, the closure means F being angularly positioned transversely to the longitudinal direction L of the film F (during this step, the two complementary strips 112, 122 are preferably mutually engaged); and heat-sealing means suitable for heat-sealing the second backing sheet 124 of the closure means 100 to an opposite face of the film F, along only one edge of said second sheet 124, downstream from the forming neck 20.

The above-mentioned heat-sealing means suitable for heat-sealing the second sheet 124 may be integrated in the transverse heat-sealing means 50.

In the accompanying figures, the lines along which the first sheet 114 is heat-sealed to the film F are referenced 115, while the line along which the second sheet 124 is heat-sealed to the film F is referenced 125.

Preferably, the segments T of closure means 100 are cut by means of a cutting tool 80 from a supply roll 82 as is shown diagrammatically in accompanying FIG. 1.

Many variant embodiments are possible for the means 60 suitable for conveying the segments of closure means 100 transversely over the film F and for heat-sealing said closure means 100 thereto. They may be generally as described in Documents U.S. Pat. No. 4,909,017, U.S. Pat. No. 4,617,683, U.S. Pat. No. 4,665,862, U.S. Pat. No. 4,666,536, U.S. Pat. No. 4,878,987, and U.S. Pat. No. 4,844,759. However, the means 60 are preferably essentially as described in French Patent FR 96 02390 filed on Feb. 27, 1996 in the Applicant's name, and in which the conveyor means 60 comprise a rectilinear guide 62 for guiding the closure means 100, which guide is superposed on the film F, transversely thereto, and is designed to position the closure means 100 accurately on the film F, and grasping or picking-up means (tongs, a needle, or a suction head) 64 which act by pulling the front end of the closure means 100, rather by pushing the back end thereof, to convey the closure means 100 into the above mentioned rectilinear guide 62. This configuration makes it possible to guarantee that the closure means 100 are deposited on the film F such that they are in the correct rectilinear state.

Thus, the segments T of closure means 100 conveyed onto and heat-sealed to the film F are preferably of length not more than one half of the width of the film F.

In addition, the segments T of closure means 100 are preferably deposited on and heat-sealed to the film F in a position that is centered across the width thereof.

In the context of the present invention, the closure means 100 may comprise two complementary strips 112, 122 disposed on respective separate backing sheets 114, 124, as shown in FIGS. 2 and 4 to 6. However, in a variant, the sheets 114, 124 carrying the complementary strips 112, 122 may be interconnected in the form of a common U-shaped backing piece 130 as shown in FIG. 3, in which case the U-shaped backing piece may have its convex face either facing forwards or facing backwards relative to the displacement direction L of the film F. However, in the context of the present invention, its convex face preferably faces backwards.

Figure 2:
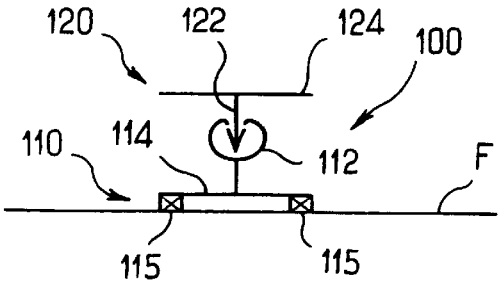
FIGS. 2 to 4 are side views of the film as equipped with the closure means, upstream from a forming neck, in three variant embodiments of the present invention.
Figure 3:
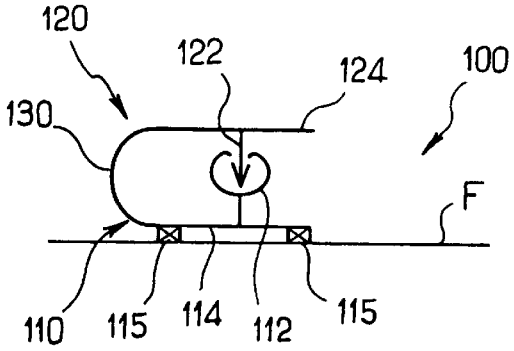
Figure 4:
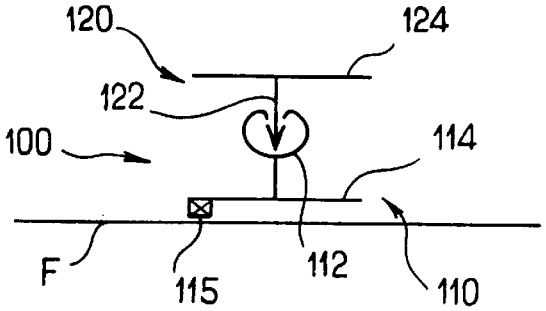
Figure 5:
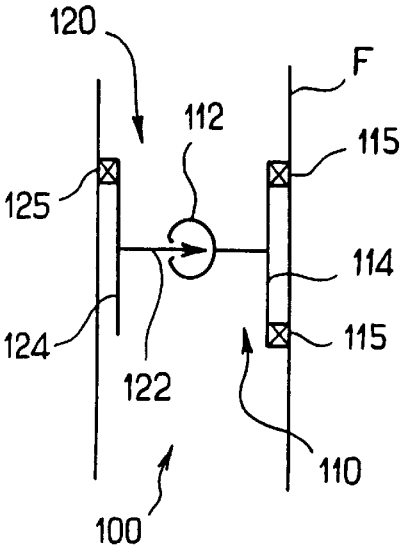
FIG. 5 is a cross-section view of the top of a bag obtained by means of such a machine.

In the embodiment shown diagrammatically in FIG. 2 and considered to be a preferred embodiment, the first backing sheet 114 of the closure means is heat-sealed to the film F along both of the longitudinal edges of said sheet, at 115. The closure means 100 are thus heat-sealed asymmetrically to the film F, as shown in FIG. 5, one of the sheets 114 being heat-sealed via both of its longitudinal edges, while the second sheet 124 is heat-sealed via one of its longitudinal edges only. However, in a variant, the first sheet 114 of the closure means 100 may be heat-sealed to the film F along only one of the longitudinal edges of said sheet, in which case the heat-sealed edge is preferably that longitudinal edge of the sheet 114 which is situated at the leading edge relative to the displacement direction L of the film F, as shown in FIG. 4. Thus the heat seal 115 formed between the sheet 114 and the film F prevents the closure means 100 from lifting away from the film F while said film is being displaced.

The heat seal 125 formed on only one longitudinal edge of the second sheet 124 is situated on that longitudinal edge which is at the trailing edge relative to the displacement direction L of the film F, as shown in FIG. 5. This heat seal 125 is thus placed closer to the mouth of the bag rather than closer to the inside volume thereof. As a result, the internal pressure of the bag urges the closure strips 112, 122 towards each other, rather than urging them apart.

Figure 6:
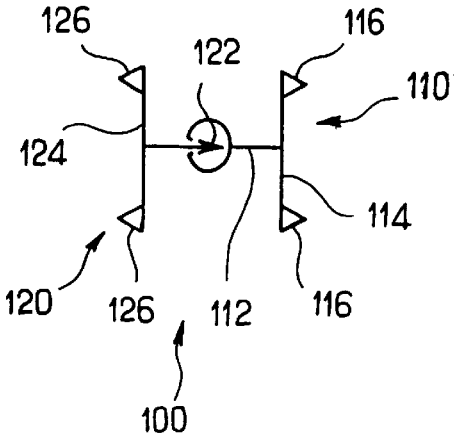
FIG. 6 is a variant embodiment of closure means suitable for being implemented in the context of the present invention.

The backing sheets 114 and 124 of the closure means 100 may optionally be provided with longitudinal lips 116, 126 along those edges of the sheets 114, 124 which are to be heat-sealed to the film F (the lips 116, 126 preferably taper going away from the sheet 114, 124, e.g. they are lips of generally triangular cross-section as defined in the French Patent Application filed in the name of the Applicant on Jun. 17, 1997 under No. 97 07490, and as shown diagrammatically in FIG. 6), or else said edges are provided with localized layers of material facilitating heat-sealing of the sheets 114, 124 along said edges.

The presence of such lips 116, 126 makes it possible, in particular, to guarantee good bonding between the sheets 114, 124 and the film F, even in the event that said sheets 114, 124 and the film F are not parallel.

The present invention offers, in particular, the following advantages:

- it offers a certain amount of tolerance for the position of the heat-sealing 115, 125 between the film F and the backing sheets 114, 124 of the closure means 100; and
- by having only one localized heat seal 125 on the second sheet 124, it makes it possible to generate leverage on the closure means 100 under the effect of the internal pressure of the bag, thereby making it possible to improve closure of the final bag, the internal pressure of the bag urging the two strips 112, 112 into mutual engagement.

The present invention is particularly applicable to making bags based on films F of plastic. However, the present invention is also applicable to making bags based on film F formed of any equivalent material, in particular based on composite film comprising a layer of paper or of metal coated with a layer of plastic.

In the context of the present invention, the backing sheets 114, 124 of the strips 112, 122 of the closure means 100 may be integrally molded with their respective strips 112, 122, or else they may be mounted separately thereon.

Moreover, numerous variant embodiments are possible for the geometrical shapes of the complementary strips 112, 122.

In the embodiment shown in the accompanying figures, the strips 112 and 122 are formed respectively by a single female element and by a single male element suitable for penetrating into said female element. However, in a variant, it is possible to use closure means 100 in which each of the strips 112 and 122 comprises a plurality of juxtaposed elements, i.e. male elements or female elements respectively, as described, for example, in Document FR-A-2 613 326.

In conventional manner, the strips 112 and 122 may also optionally be provided with abutment ribs or shoulders preferably disposed at the ends of the male element and of female element, to guarantee that the elements engage each other reliably.

The accompanying figures show closure means 100 provided with two backing sheets 114, 124 of substantially identical width. In a variant, it is possible to use backing sheets 114, 124 of significantly different widths.

Naturally, the present invention is not limited to the above-described particular embodiments, but rather it extends to any variant lying within the spirit of the invention.

In particular, although the forming, filling, and closing machine that is shown, is of the vertical type, i.e. it is a machine in which the forming neck 20 is disposed vertically, the present invention is also applicable to a machine that is of the horizontal type, or that slopes relative to the vertical and to the horizontal.

Such a horizontal-type machine essentially comprises:

- conveyor means for conveying a film F in a longitudinal direction;
- deposition means for depositing the product to be packaged on the film F;

forming means for forming the film F around the product;

longitudinal heat-sealing means 40; and transverse heat-sealing and bag-separation means 50.

In addition, the step of heat-sealing the first backing sheet 114 of the closure means 100 to the film F may be performed on the bag forming, filling and closing machine, immediately upstream from the forming means 20, during a continuous method, or else, the first backing sheet 114 of the closure means 100 may be heat-sealed to the film F during a step performed prior to implementing the method on the automatic forming, filling and closing machine as shown in FIG. 1, the resulting film F thus equipped with the closure means 100 being conditioned prior to being conveyed to the forming means 20 of said machine for implementation of the above-mentioned method.

Furthermore, in the context of the present invention, the resulting bags may have numerous characteristics in addition to the above-described characteristics, such as score lines, opening or decorative borders etc.

What is claimed is:

1. A method of forming and closing bags, said method comprising the following steps:

delivering closure means comprising at least two complementary strips disposed on respective backing sheets;

delivering a film that is to constitute the walls of the bag;

heat-sealing a first backing sheet of the closure means to the film along at least one of the longitudinal edges of said sheet, with the closure means being angularly positioned transversely to the longitudinal direction of the film;

shaping the resulting film as equipped with the closure means into a tube; and heat-sealing the second backing sheet of the closure means to an opposite face of the film along a trailing only one edge of said second sheet.

2. A method according to claim 1, wherein the two complementary strips are in the mutually engaged state during the step of heat-sealing the first backing sheet to the film.

3. A method according to claim 1, wherein the segments of closure means conveyed onto and heat-sealed to the film are of length not more than one half of the width of the film.

4. A method according to claim 1, wherein the closure means comprise two complementary strips disposed on respective separate backing sheets.

5. A method according to claim 1, wherein the closure means comprise two complementary strips disposed on backing sheets that are interconnected in the form of a common U-shaped backing piece.

6. A method according to claim 5, wherein the U-shaped backing piece has its convex face facing backwards relative to the displacement direction of the film.

7. A method according to claim 1, wherein the first backing sheet of the closure means is heat-sealed to the film along both of the longitudinal edges of said sheet.

8. A method according to claim 1, wherein the first backing sheet of the closure means is heat-sealed to the film via one its longitudinal edges only.

9. A method according to claim 8, wherein the backing sheet is heat-sealed to the film along that longitudinal edge of the sheet which is situated at the leading edge relative to the displacement direction of the film.

10. A method according to claim 1, wherein the first backing sheet of the closure means is heat-sealed to the film during a step performed prior to implementing the method on the automatic forming and closing machine, the resulting film thus equipped with the closure means being conditioned prior to being conveyed to the forming means of said machine.

11. A method according to claim 1, implemented on an automatic forming, filling, and closure machine of the vertical type.

12. A method according to claim 1, implemented on an automatic forming, filling, and closure machine of the horizontal type.

13. A method according to claim 1, wherein the step of heat-sealing the first backing sheet of the closure means to the film is performed on a bag forming and closure machine immediately upstream from the forming means during a continuous method.

* * * * *